United States Patent [19]

Janson

[11] 4,375,590

[45] Mar. 1, 1983

[54] TEMPERATURE REGULATOR MOUNTING ARRANGEMENT FOR ELECTRIC SAUNA HEATING UNITS

[75] Inventor: Mats O. Janson, Port, Switzerland

[73] Assignee: Tylo Sauna S.A. Corporation, Biel-Bienne, Switzerland

[21] Appl. No.: 102,369

[22] Filed: Dec. 11, 1979

[30] Foreign Application Priority Data

Jun. 14, 1979 [SE] Sweden ..... 7905230

[51] Int. Cl.[3] ..... H05B 1/02; A61H 33/06; F24H 9/20

[52] U.S. Cl. ..... 219/364; 4/524; 126/344; 128/367; 219/272; 219/362; 219/363; 219/367

[58] Field of Search ..... 219/362–368, 219/271–276, 361; 126/344; 128/367, 368

[56] References Cited

U.S. PATENT DOCUMENTS

| | | | |
|---|---|---|---|
| 3,769,494 | 10/1973 | Janson | 219/364 |
| 4,045,652 | 8/1977 | Janson | 219/363 |
| 4,227,068 | 10/1980 | Carter | 219/366 |

*Primary Examiner*—A. Bartis

*Attorney, Agent, or Firm*—Holman & Stern

[57] ABSTRACT

An electric sauna heating unit provided with electric heating elements arranged in a casing through which sauna room air flows to be heated has a temperature regulator including a transmitter, such as a thermostat bulb or thermistor, for sensing the temperature in the sauna room and a thermostat responsive thereto for connecting or disconnecting the heating elements in accordance with signals from the transmitter. The transmitter is mounted remotely from the heated air flow from the unit on an imperforate sidewall (preferably, the backwall) of the casing in spaced relationship thereto so as to be exposed only to the air flow in the sauna room and is located substantially horizontally and symmetrically relative to the center line of the unit and within the upper third of the height of the unit at a distance of 10–20 cm from the upper edge thereof. The transmitter is enclosed in a protective cover provided with air flow passages. The inner surface of the casing sidewall immediately adjacent the transmitter is designed to reflect heat radiation from the heating elements back toward the elements in order to reduce the effect of such heat radiation on the transmitter.

2 Claims, 5 Drawing Figures

TEMPERATURE REGULATOR MOUNTING ARRANGEMENT FOR ELECTRIC SAUNA HEATING UNITS

BRIEF SUMMARY OF THE INVENTION

The present invention refers to a temperature regulator for electric sauna heating units and is of the kind comprising a transmitter, e.g. a bulb, a thermistor or the like, which by means of a capillary tube, a line or similar device is connected to a thermostat, which depending on the temperature changes sensed by the transmitter connects or disconnects the heating elements of the sauna heating unit.

The temperature in sauna rooms has hitherto been controlled by means of a transmitter, e.g. a bulb or a thermistor placed in the so called bathing zone, where the persons taking a sauna bath are staying and where the temperature must be as constant as possible. Manufacturers of sauna equipment generally recommend that the transmitter be placed about ½ meter above the floor of the sauna room and at least ½ meter to the side of the sauna heating unit. In most saunas the control panel with controls for adjusting the temperature in the sauna is placed outside the sauna room, which means that lines have to be arranged between the control panel and the heater and a connection in the form of a line or a capillary tube has to be arranged between the control panel and the transmitter in the sauna room. There are also sauna heating units where the control panel is builtin to the lower part of the heater, but also in this case the bulb or the thermistor is placed at a sufficient distance from the heater, so that this does not misleadingly effect the transmitter. If the transmitter is placed too close to the heater the temperature setting will be considerably exceeded. The best placing of the transmitter depends on the power and the placing of the heater, the size of the sauna room and how the ventilation in the sauna room has been arranged.

The object of the present invention is to completely eliminate the mounting of the transmitter in the sauna room and its connection to the thermostat. This object has been achieved by attaching the transmitter to the outer casing of the sauna heating unit, preferably on the backwall thereof, at a small distance from the casing, at least the area of the casing located just opposite the transmitter comprising a material which reduces and/or reflects the heat radiation from the heating elements inwards towards said elements, and the thermostat being arranged in a control case, which can be mounted on the heating unit or outside this at some distance therefrom.

By the proposed placing of the transmitter on the outer casing of the sauna heating unit a very old problem has been eliminated, viz. the temperature sensing means for controlling the heater has to be placed where the sauna bathers are situated.

DESCRIPTION OF SOME EMBODIMENTS

Figure 1:
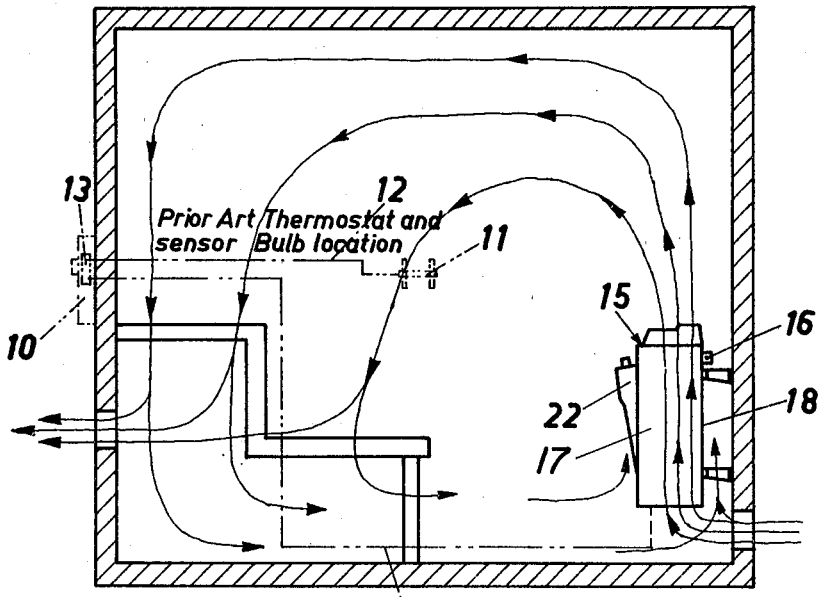
FIG. 1 is a schematic section through a sauna room showing a sauna heating unit provided with a temperature regulator according to the invention.

In FIG. 1 is shown with dash-dotted lines a conventional arrangement for temperature control and comprising a control panel 10 located outside the sauna room and a transmitter 11, e.g. a bulb, which by way of a capillary tube 12 is connected to a thermostat 13 arranged in the control panel 10. A line 14 is arranged from the control panel 10 to the sauna heating unit 15 for connecting and disconnecting the heating elements of the sauna heating unit.

Figure 2:
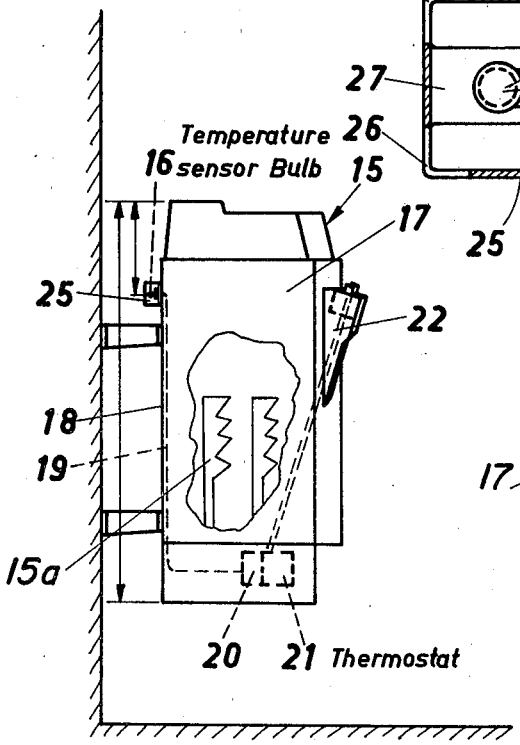
FIG. 2 shows the sauna heating unit of FIG. 1 on a larger scale with parts broken away to show heating elements.
Figure 3:
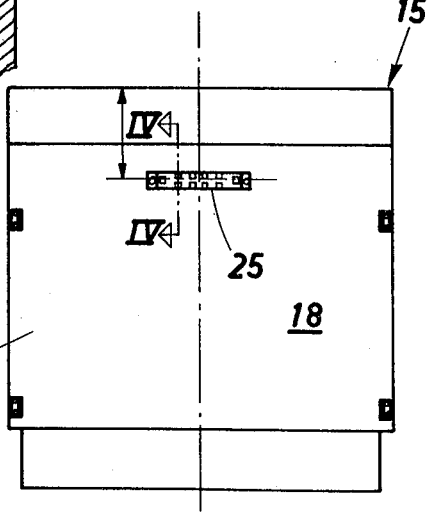
FIG. 3 is a rear view in elevation of the sauna heating unit of FIG. 2.

According to the present invention the transmitter 11 is not in the conventional way placed within the bathing zone but is instead mounted on the outer casing 17 of the sauna heating unit 15, preferably on the backwall 18 thereof, as shown in FIG. 2. The transmitter 16, which can be a thermistor or a bulb, is through a line or a capillary tube 19 connected to the thermostat 20 arranged in a coupling case 21, in which also other control equipment can be arranged, such as a timer, a switch, etc. These controls are preferably operated from a control panel 22 on the front side of the sauna heating unit. The heating elements 15*a* are schematically shown only since their design is not intended to be a part of this invention.

Figure 5:
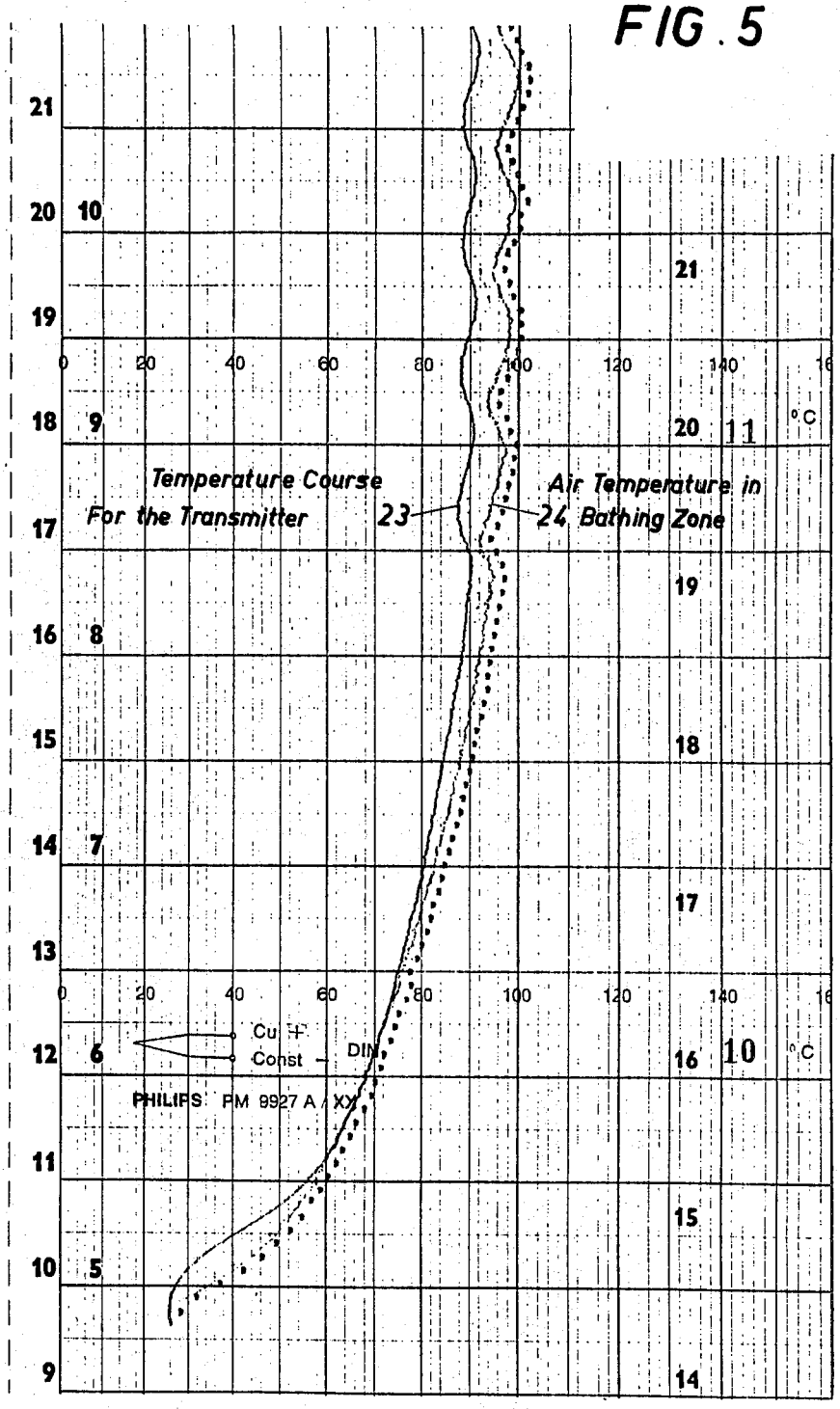
FIG. 5 is a diagram of the temperature course on one hand when the transmitter is placed at the sauna heating unit and on the other hand within the bathing zone of the sauna room.

Since the size and volume of sauna rooms as well as the power and placing of the sauna heating units vary for different saunas and since also the ventilation arrangements have to be adapted for the local conditions it was very difficult to find a placing for the transmitter 16, which is appropriate for most cases. The demand was to find a position, which during substantially the entire temperature course shows a linear relation with the temperature of the bathing zone. A placing of the transmitter 16 which has proved to fullfil the above demands is substantially horizontal and symmetrical in relation to the vertical center line of the heating unit. The transmitter should further be placed within the upper third of the height of the heating unit at a distance of 10–20 cm from the upper edge of the heating unit. A distance of 15 cm from the upper edge has resulted in the temperature graphs shown in the diagram of FIG. 5. In the diagram the temperature is denoted in degrees Celsius on the axis of abscissa and the time on the axis of ordinate, where each interval between the bold lines includes 10 min. In the diagram the graph 23 shows the temperature course for the transmitter 16, which in this experiment was a bulb, while the graph 24 shows the air temperature in the bathing zone 150 cm above the floor in the sauna room. The graphs concern a sauna heating unit with a power of 6 kw, the air volume in the sauna room being 12 $m^3$ and the ventilation of the room being moderate. The stone holder of the sauna heating unit was filled with stones. It can be clearly seen from the diagram that the graphs are running essentially parallel close to each other. The thermostat 20 is provided with fixed calibration means (not shown) for compensating the difference between the temperature graphs, i.e. the desired air temperature in the sauna (desired value) in relation to the temperature measured at the sauna heating unit (actual value).

Figure 4:
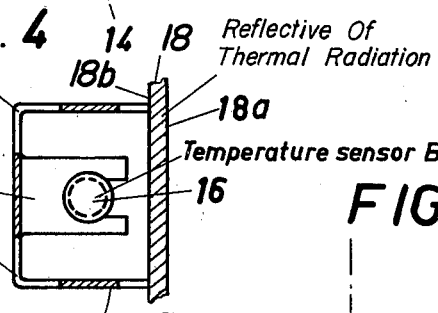
FIG. 4 is a section taken along the line IV—IV in FIG. 3.

The bulb 16 is preferably enclosed by a protective cover 25 attached to the outer surface 18*b* of backwall 18 of casing 17 as best shown in FIG. 4, which at the upper and the lower part is provided with passages 26 for allowing the air to pass through. The protective cover is also provided with a holder 27 for mounting the bulb 16 at a distance from the backwall 18 of the casing of the heating unit 15. The backwall 18 of the casing 17, or at least the area adjacent the bulb, comprises a material which is heat reducing and/or which reflects the heat radiation from the heating elements 15*a* in the casing impinging on the inner surface 18*a* of the backwall back towards the heating elements of the heating unit in order to reduce the heat radiation from the outer surface 18*b* to bulb 16. A material such as aluminum plate has proved to be sufficiently effective, for this purpose but also other materials are possible to use, e.g. steel plate covered with a heat reducing layer, e.g. a valour-like flock covering.

What I claim is:

1. In an electric sauna heating unit having electric heating elements arranged in a casing which is open at its top and bottom for air flow therethrough over the heating elements, and including a temperature regulator comprising a transmitter for sensing the temperature in the sauna room, a thermostat, means operably connecting said transmitter to said thermostat and means operably connecting said thermostat to said electric heating elements so that the thermostat connects or disconnects the heating elements in response to signals from said transmitter, the improvement comprising said transmitter being mounted on an imperforate sidewall of the casing of the sauna heating unit in spaced relationship to the sidewall and arranged so as to be exposed only to the air flow in the sauna room and not directly to the air flow eminating from the heating unit, said transmitter being located substantially horizontal and symmetrical relative to the vertical center line of the heating unit and within the upper third of the height of the heating unit at a distance of 10–20 cm from the upper edge of the heating unit, and a heat-reducing means in at least the area of said sidewall located adjacent the transmitter comprising at least said area of said sidewall being a material which reflects the heat radiation from the heating elements back towards said elements, a control case mounted on the sauna heating unit, and said thermostat being mounted in said control case.

2. The improvement in an electric sauna according to claim 1, wherein the transmitter is enclosed by a protective cover which at its upper and lower parts is provided with air passages for circulation of air from the sauna room therethrough and said material of said heat reducing means is aluminum.

* * * * *